US006294003B1

(12) United States Patent
Ray

(10) Patent No.: US 6,294,003 B1
(45) Date of Patent: Sep. 25, 2001

(54) MODULAR CONDENSING WET ELECTROSTATIC PRECIPITATORS

(75) Inventor: Isaac Ray, Brooklyn, NY (US)

(73) Assignee: Croll Reynolds Clean Air Technologies, Inc., Westfield, NJ (US)

( * ) Notice: Subject to any disclaimer, the term of this patent is extended or adjusted under 35 U.S.C. 154(b) by 0 days.

(21) Appl. No.: 09/791,233

(22) Filed: Feb. 22, 2001

Related U.S. Application Data

(63) Continuation-in-part of application No. 09/281,246, filed on Mar. 30, 1999, now Pat. No. 6,193,782.

(51) Int. Cl.[7] ..... B03C 3/014

(52) U.S. Cl. ..... 96/49; 55/DIG. 38; 96/74; 96/97; 96/100

(58) Field of Search ..... 96/49, 74, 100, 96/97, 98; 95/4, 67, 73; 55/DIG. 38

(56) References Cited

U.S. PATENT DOCUMENTS

| | | | |
|---|---|---|---|
| 1,325,136 | 12/1919 | Bradley | 55/DIG. 38 |
| 1,393,712 | 10/1921 | Steere et al. | 95/73 |
| 1,473,806 | 11/1923 | Bradley | 55/DIG. 38 |
| 1,752,920 | 4/1930 | McCloskey | 55/DIG. 38 |
| 1,826,428 | 10/1931 | Miller | 55/DIG. 38 |
| 1,959,752 | 5/1934 | Wintermute | 96/49 |
| 1,997,729 | 4/1935 | Herber | 55/DIG. 38 |
| 2,592,508 | 4/1952 | Phyl | 55/DIG. 38 |
| 3,793,802 | 2/1974 | Hardt | 55/DIG. 38 |
| 4,155,792 | 5/1979 | Gelhaar et al. | 55/DIG. 38 |
| 5,039,318 | 8/1991 | Johansson | 96/74 |
| 5,084,072 | 1/1992 | Reynolds | 96/88 X |
| 5,922,111 | 7/1999 | Omi et al. | 96/100 X |
| 6,193,782 * | 2/2001 | Ray | 95/4 |

FOREIGN PATENT DOCUMENTS

| | | | |
|---|---|---|---|
| 3927569 | 2/1991 | (DE) | 96/100 |
| 1169413 | 12/1958 | (FR) | 55/DIG. 38 |
| 714589 | 9/1954 | (GB) | 55/DIG. 38 |

OTHER PUBLICATIONS

Starke et al, "The Wet Wall Electrostatic Precipitator.", Undated.

* cited by examiner

*Primary Examiner*—Richard L. Chiesa
(74) *Attorney, Agent, or Firm*—Arthur Jacob

(57) ABSTRACT

A condensing wet electrostatic precipitator for cleaning hot gases is constructed of collection electrode modules which establish longitudinally extending collection electrodes and a cooling jacket, each collection electrode module having a configuration including at least one part-tubular section and a cooling fluid chamber integral with the part-tubular section for containing cooling medium for cooling the part-tubular section. In some arrangements, the collection electrode modules are spaced apart laterally to enable the passage of the hot gases through the collection electrodes in a direction transverse to the longitudinal direction in which the collecting electrodes extend.

8 Claims, 7 Drawing Sheets

MODULAR CONDENSING WET ELECTROSTATIC PRECIPITATORS

This is a continuation-in-part of application Ser. No. 09/281,246, filed Mar. 30, 1999, now U.S. Pat. No. 6,193,782.

The present invention relates generally to condensing wet electrostatic precipitators and pertains, more specifically, to a modular arrangement for improving the construction and performance of condensing wet electrostatic precipitators.

The continuing pursuit of more stringent regulations pertaining to the control of contaminants emitted into the ambient atmosphere has led to the requirement for more effective treatment of emissions emanating from commercial and industrial processes. In particular, the removal of toxic substances from industrial exhausts has received increased attention. Recent studies have suggested that the presence of submicron particles cause much of the illnesses associated with air pollution. Accordingly, greater emphasis has been placed upon the removal of such fine particulates from industrial exhausts.

One of the more recent advancements in the removal of fine particulates from a gas stream is the utilization of condensing wet electrostatic precipitators wherein the particulates carried by an incoming gas stream are entrained in condensate formed on walls of the precipitator and are flushed from the walls for collection. The present invention provides improvements in the construction and operation of condensing wet electrostatic precipitators. As such, the present invention attains several objects and advantages, some of which are summarized as follows: Facilitates the fabrication and installation of a condensing wet electrostatic precipitator, enabling more economical construction and encouraging more widespread use of condensing wet electrostatic precipitators; enables ease of maintenance and repair of condensing wet electrostatic precipitators, with reduced shutdown requirements and extended continuous operation; allows the use of less expensive materials and construction techniques in the fabrication and installation of condensing wet electrostatic precipitators; utilizes a heat exchange arrangement which increases the effectiveness and efficiency of heat transfer in cooling the condensing walls of a condensing wet electrostatic precipitator; provides better control over the temperature of the walls of the condensing electrodes in a condensing wet electrostatic precipitator for providing better control over conditions desired for the formation of particle-capturing and flushing condensate, thereby increasing the efficiency and effectiveness of the condensing wet electrostatic precipitator in the removal of particulates; allows the construction and installation of larger condensing wet electrostatic precipitators with increased ease and economy; facilitates the fabrication of components of a condensing wet electrostatic precipitator in the factory and assembly in the field to enable greater ease and economy; provides apparatus and process for effective and reliable operation over an extended service life.

The above objects and advantages, as well as further objects and advantages, are attained by the present invention which may be described briefly as an improvement in a wet electrostatic precipitator having discharge electrodes extending in a longitudinal direction within generally tubular collection electrodes placed within a cooling jacket containing a cooling medium for cooling the collection electrodes as hot gases are passed through the collection electrodes in a transverse direction transverse to the longitudinal direction, the improvement comprising: collection electrode modules for establishing the collection electrodes and the cooling jacket, each collection electrode module having a configuration including at least one part-tubular section and a cooling fluid chamber integral with the part-tubular section for containing cooling medium for cooling the part-tubular section; the configuration of each collection electrode module being such that upon assembly of the collection electrode modules into an assembly of juxtaposed collection electrode modules the part-tubular sections are juxtaposed to establish at least one corresponding generally tubular collection electrode comprised of the juxtaposed part-tubular sections, and are spaced apart laterally to enable the hot gases to pass through the collection electrodes in the transverse direction, and the cooling fluid chambers are juxtaposed to establish a corresponding cooling jacket comprised of the juxtaposed cooling fluid chambers.

The invention will be understood more fully, while still further objects and advantages will become apparent, in the following detailed description of preferred embodiments of the invention illustrated in the accompanying drawing, in which.

Figure 1:
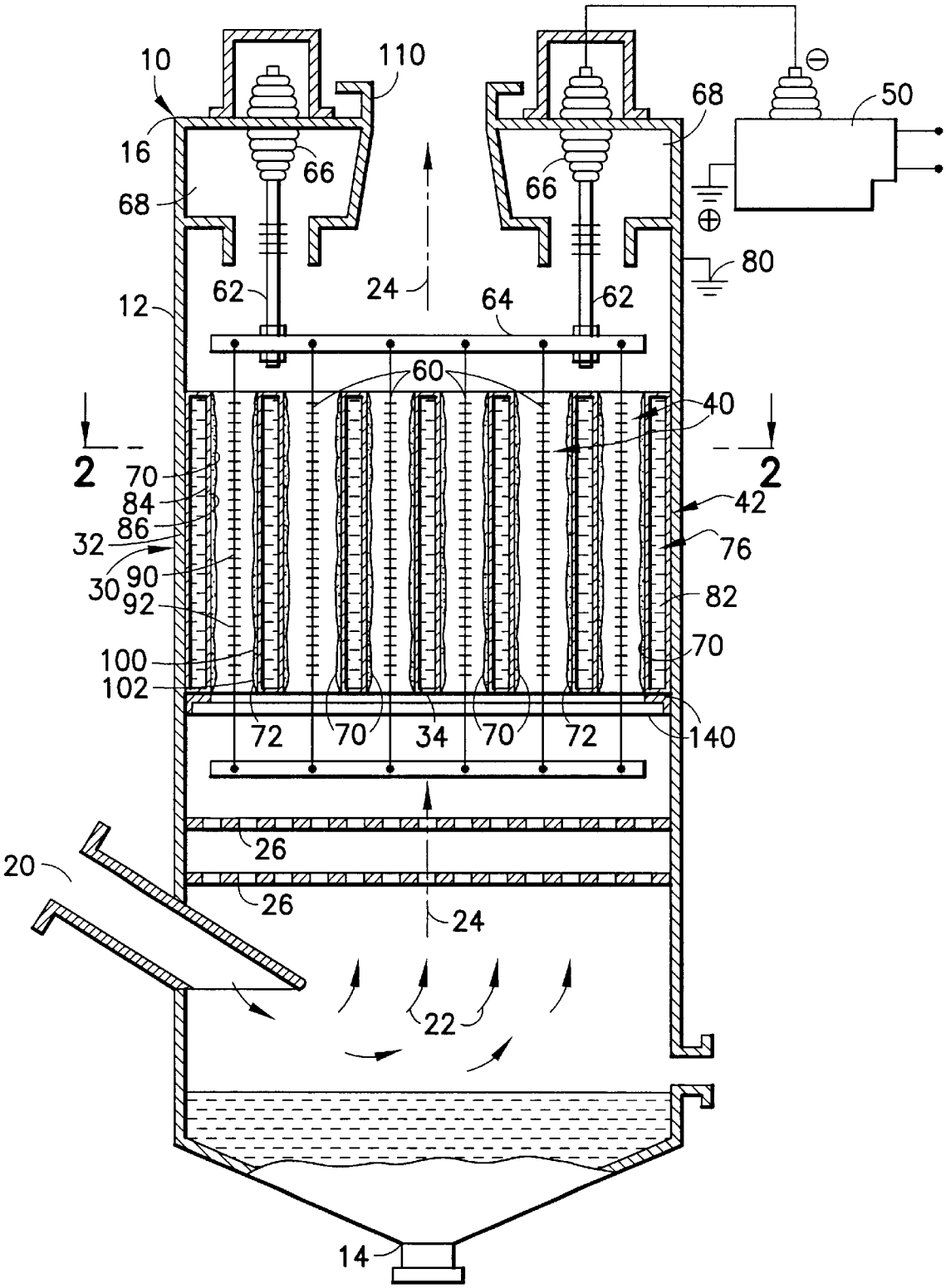
FIG. 1 is a partially diagrammatic, longitudinal cross-sectional view of an apparatus employing improvements of the present invention.

Referring now to the drawing, and especially to FIG. 1 thereof, an apparatus which utilizes an improvement of the present invention is illustrated generally at 10 and is seen to include a housing 12 which extends vertically from a lower bottom end 14 to an upper top end 16. An inlet is shown in the form of a port 20 located adjacent the bottom end 14 and receives an incoming gas stream, as indicated by arrows 22, laden with moisture and with contaminants to be removed from the stream. The incoming gas stream 22 is directed upwardly along a vertical path of travel 24 and through perforated plates 26 toward a condensing wet electrostatic precipitator section 30 wherein the gas stream 22 passes through a condensing wet electrostatic precipitator 32.

Figure 2:
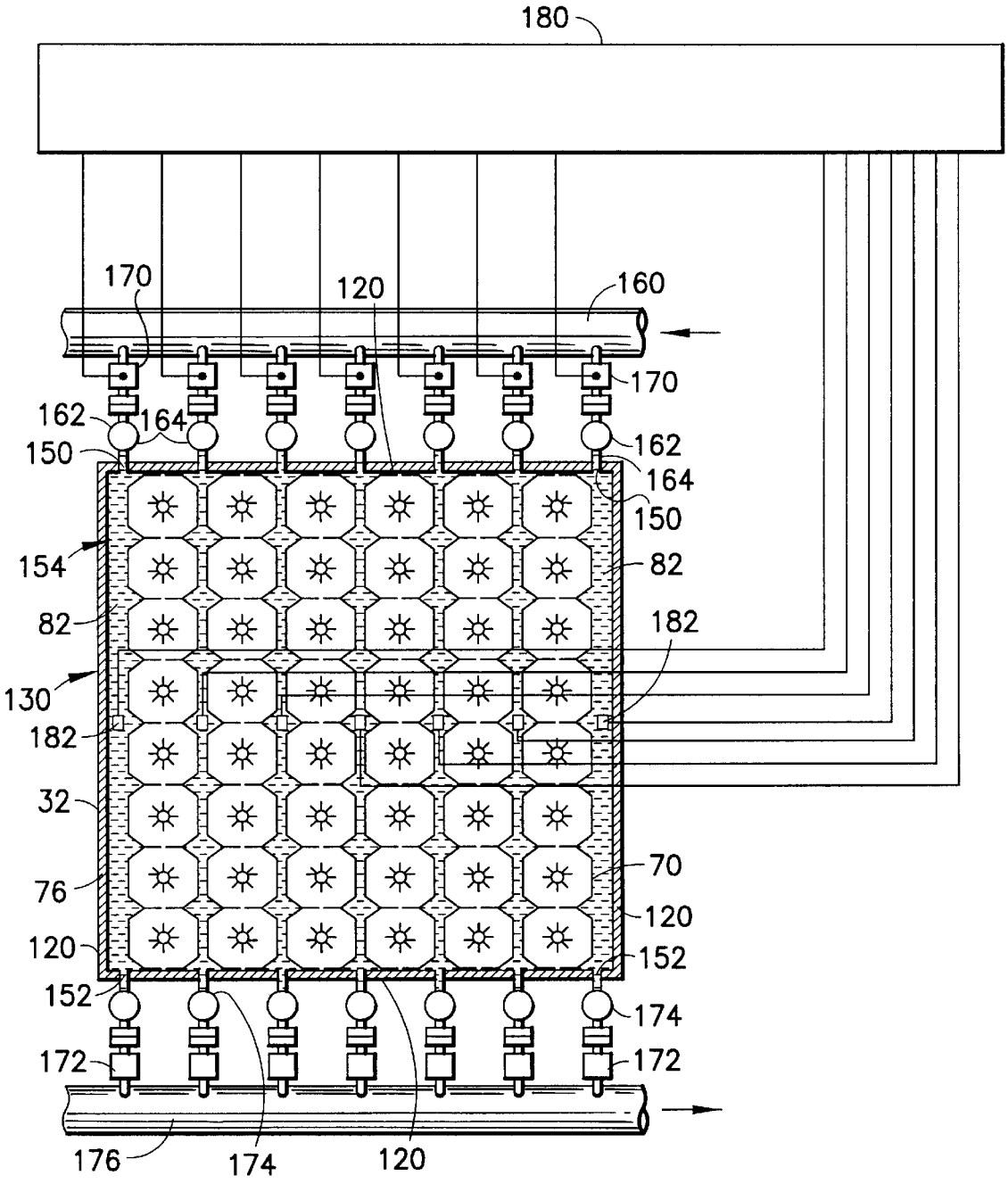
FIG. 2 is a partially schematic transverse cross-sectional view taken along line 2—2 of FIG. 1.

Precipitator 32 includes an inlet area 34 extending transversely across the condensing wet electrostatic precipitator section 30, and a plurality of electrode assemblies 40 arranged in a matrix 42, as seen in FIG. 2, the matrix 42 extending across the inlet area 34 and the electrode assemblies 40 being powered by a source 50 of high voltage, in a now conventional manner. To that end, the source 50 is connected to discharge electrodes 60 of the electrode assemblies 40 through a support assembly which includes support members 62 and a support frame in the form of a bus frame 64 supported by insulator members in the form of insulators 66 placed in corresponding chambers 68. The bus frame 64 is suspended below the insulators 66 by the support members 62, and the discharge electrodes 60 are suspended downwardly from the bus frame 64 such that each discharge electrode 60 passes through the center of a corresponding collection electrode 70 having a tubular wall 72 and is connected to the source 50 so that the discharge electrodes 60 carry an electrostatic charge of given polarity and the collection electrodes 70 carry an electrostatic charge having a polarity opposite to the given polarity. In the illustrated embodiment, the discharge electrodes 60 carry a negative charge, while the collection electrodes 70 carry a positive charge, the collection electrodes 70 being connected to ground at 80.

A coolant jacket 76 surrounds the electrode assemblies 40 and, more specifically, the tubular walls 72 of the collection electrodes 70 surrounding the discharge electrodes 60 in the matrix 42 so as to enable circulation of a coolant, shown in the form of water 82, around the outside of the tubular walls 72, in contact with the outside surfaces 84 of the tubular walls 72, to maintain the temperature of the inside surfaces 86 of the tubular walls 72 at a level most conducive to condensation of the moisture carried by the gas stream 22 on the inside surfaces 86 of the tubular walls 72 as the gas stream 22 passes through the interior of the tubular walls 72.

The discharge electrodes 60 each include an ionizing section 90 having relatively sharp points 92. As known in electrostatic precipitators, a strong electrostatic field is generated in each electrode assembly 40, between the discharge electrode 60 and the collection electrode 70, and the sharp points 92 cause corona discharge. As the gas stream 22 passes between the discharge electrode 60 and the collection electrode 70 of each electrode assembly 40, particulates carried in the gas stream 22 are intercepted by negatively charged gas ions moving toward the tubular wall 72 and the particulates become fully saturated with charge. The strong electrostatic field causes the charged particulates, illustrated at 100, together with entrained moisture from the fully saturated gas stream 22, to migrate to the inside surface 86 of the tubular wall 72. The cooled inside surface 86 enables condensation of the moisture from the saturated gas stream 22, establishing a film of condensate 102 on the inside surface 86. The condensate 102 runs down the tubular wall 72 and flushes away the particulates 100 attracted to the inside surface 86, thus creating a self-cleaning mechanism which is a hallmark of a condensing wet electrostatic precipitator. In this manner, submicron particulates are removed from the gas stream 22, and the cleaned gas stream 22 proceeds upwardly along path of travel 24 to be discharged through an outlet 110 at the top end 16 of the housing 12 as an outgoing gas stream.

Figures 3, 4:
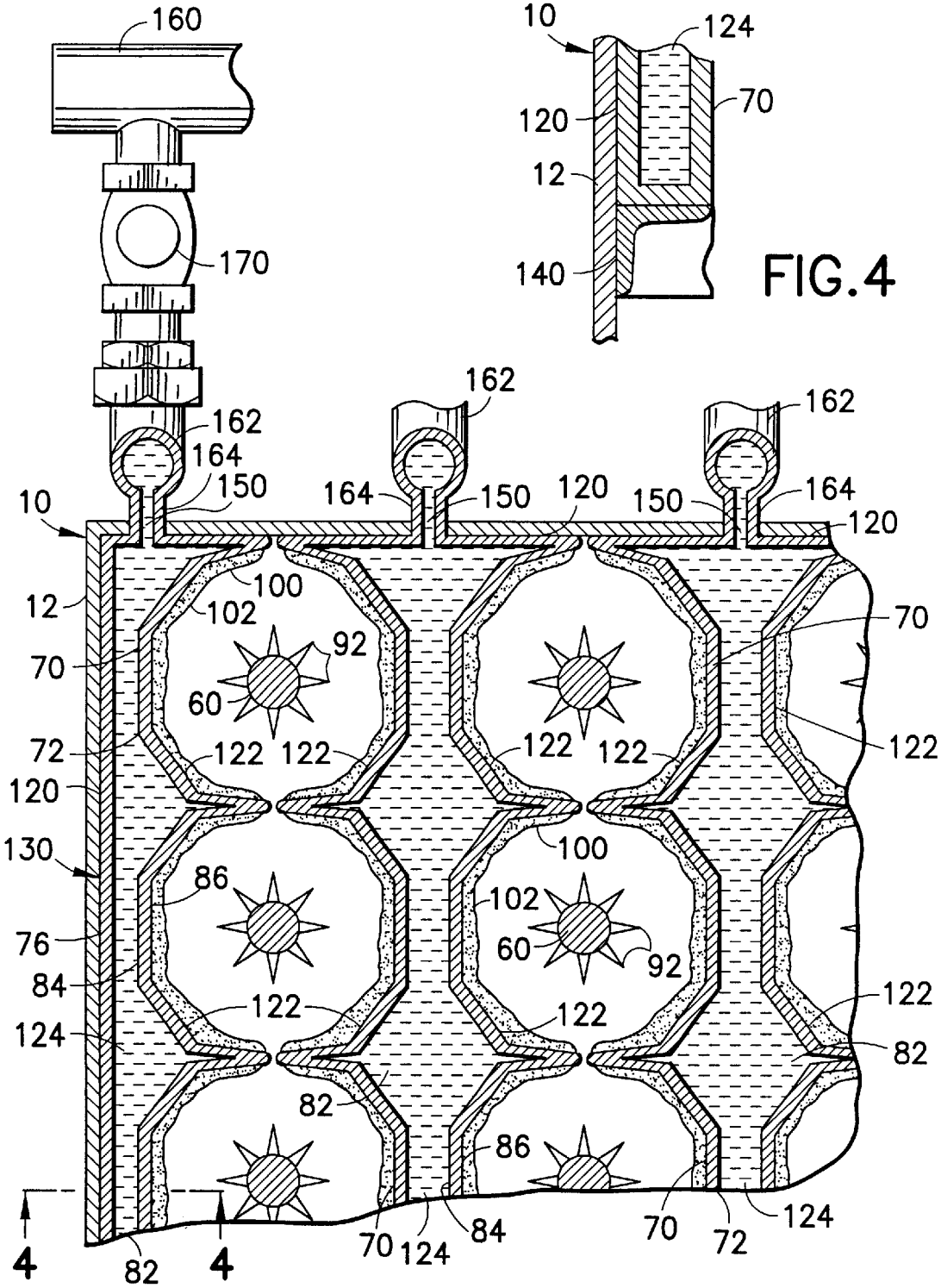
FIG. 3 is an enlarged fragmentary view of a portion of FIG. 2.
FIG. 4 is a fragmentary cross-sectional view taken along line 4—4 of FIG. 3.

Turning now to FIGS. 2 and 3, in one embodiment of the improvements of the present invention, the condensing wet electrostatic precipitator 32 is provided with a modular construction, including a plurality of collection electrode modules 120 which establish the collection electrodes 70 and the cooling jacket 76. Each collection electrode module 120 has a configuration which includes at least one, and preferably several, part-tubular sections shown in the form of sections 122, and a cooling fluid chamber, illustrated at 124, for containing cooling medium, such as water 82, for cooling the section 122, preferably through direct contact with the section 122. The configuration of each collection electrode module 120 is such that upon assembly of the collection modules 120 into an assembly of juxtaposed collection modules 120, as illustrated at 130, the sections 122 are juxtaposed to establish corresponding generally tubular collection electrodes 70, comprised of the juxtaposed part-tubular sections 122. At the same time, the cooling fluid chambers 124 are juxtaposed to establish cooling jacket 76, the cooling jacket 76 being comprised of juxtaposed discrete cooling fluid chambers 124 isolated from one another by the construction of the individual modules 120. In the illustrated assembly 130, each part-tubular section 122 is a semi-tubular section so that each collection electrode 70 is completed by juxtaposing just two semi-tubular sections, as shown in FIGS. 2 and 3.

The modular construction of the condensing wet electrostatic precipitator 32 enables the fabrication of smaller modules 120 at a manufacturing location, and transport of the smaller modules 120 to an installation location in the field where the smaller modules 120 are assembled into a much larger assembly 130. In this manner, a larger condensing wet electrostatic precipitator is constructed with greater ease and economy, and without requiring the transportation of a large, completed assembly from the factory to the field. In addition, the smaller modules 120 enable the use of economical manufacturing techniques, such as the use of automated welding robots and other automated fabricating machinery, not otherwise readily available in the construction in the factory of large assemblies. Further, the modules 120 may be made of various materials utilizing extrusion or molding techniques, as well as conventional metal fabricating techniques, for later assembly in any selected number, held together in the field in a securing frame, shown in the form of brackets 140 in the housing 12 (also see FIGS. 1 and 4), for establishing a much larger condensing wet electrostatic precipitator at a selected installation. Since the water 82 circulated through the modules 120 is an electrical conductor, the employment of water-jacketed modules 120 enhances the use of electrically conductive synthetic polymeric materials, such as conductive fiberglass reinforced polyesters, for the walls 72 of the modules 120 in that the connection of the collection electrodes 70 to ground, as illustrated at 80, is enhanced. Such enhanced electrical performance renders more practical the use of corrosion resistant reinforced synthetic polymeric materials for attaining a longer service life. Further, heat dissipation at the walls 72 of the collection electrodes 70 realized by the circulation of cooling water 82 through the modules 120 militates against burning and erosion from corona discharge along the collection electrodes 70, thereby enabling increased service life.

While the perforated plates 26 are placed below the condensing wet electrostatic precipitator 32 in an effort to distribute the stream 22 evenly across the inlet area 34 of the precipitator 32, the plates 26 are not always entirely effective, allowing an uneven flow of hot gases through the inlet area 34, with the result that some of the collection electrodes 70 are subjected to higher temperatures than others. As illustrated in FIGS. 2 and 3, the arrangement wherein modules 120 are assembled in the assembly 130 provides individual, discrete cooling fluid chambers 124 isolated from one another within the integrated assembly 130. Each chamber 68 is supplied with cooling water 82 through an inlet 150, and the cooling water 82 passes over the sections 122 to cool the corresponding collection electrode 70, the water 82 then being ejected at an outlet 152 to complete a cooling circuit 154. The cooling circuit 154 is a part of a cooling fluid distributor arrangement which includes a cooling water supply manifold 160 interconnected with a distribution manifold 162 and distribution passages 164. A regulator which includes a proportional valve 170 in the cooling circuit 154 controls the flow of cooling water 82 to the chamber 124, through passages 164, and a further valve 172 is located at the outlet 152 of the cooling circuit 154 and controls the flow of cooling water 82 from passages 152 through a collection manifold 174, and into an outlet manifold 176. Proportional valve 170 is controlled by a controller, shown in the form of a processor 180, and a temperature sensor 182 is located within each module 120 to sense the temperature within each module 120 and forward that temperature information to the processor 180. The processor 180 then controls the valve 170, in response to the temperature information received from the sensor 182, to regulate and maintain a desired temperature at the inside surface 86 of the wall 72 of the collection electrodes 70 of each module 120. In this manner, temperature is controlled individually within each module 120 in response to temperature demands at the collection electrodes 70, with a concomitant closer control of condensation along the inside surfaces 86 of the walls 72 of the collection electrodes 70 for more efficient and more effective removal of contaminants from the stream 22.

It is noted that conventional condensing wet electrostatic precipitators ordinarily exhibit variations of about fifteen percent in gas flow distribution across the inlet area of the precipitator. Conventional methods for minimizing such variations in gas flow volume rely upon the use of baffles or similar devices which introduce relatively large pressure drops in an effort to even the distribution of gas flow across the precipitator. While such techniques are acceptable for small and medium volumes of gas flow, a large pressure drop coupled with high volume gas flow, such as encountered in power plants, for example, will result in very high energy consumption by the gas moving apparatus. The present improvements allow the maintenance of low pressure drops while attaining the desired condensing conditions throughout the condensing wet electrostatic precipitator.

While in conventional condensing wet electrostatic precipitators even a small leak in the cooling jacket can result in shutdown of the entire precipitator, the modular arrangement of condensing wet electrostatic precipitator 32 allows any such leak in a module 120 to be stopped without the necessity for shutting down the remaining fully functional modules 120. Avoiding shutdown of an entire precipitator avoids costly consequences, such as loss of production and possible environmental contamination. Thus, any leaking module 120 merely is isolated from the remaining modules 120, as by closing corresponding valves 170 and 172, and repair or replacement then may be effected during regular periodic maintenance of the precipitator.

Figure 5:
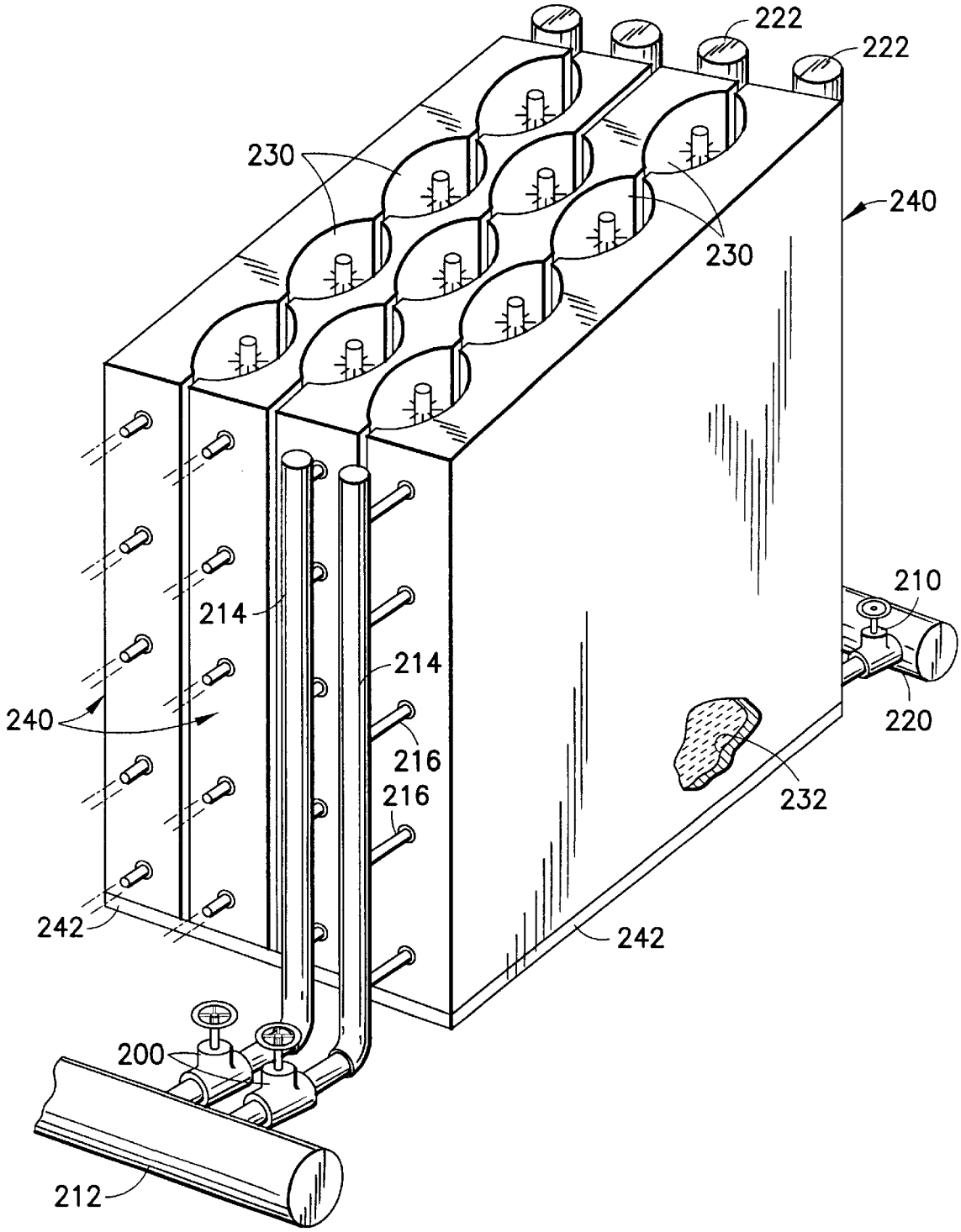
FIG. 5 is a pictorial perspective view of another apparatus incorporating improvements of the present invention.

In the embodiment illustrated in FIG. 5, manually operated inlet valves 200 and outlet valves 210 are placed in a cooling circuit which includes a cooling fluid distributor arrangement having a supply manifold 212, distribution manifolds 214 and inlet conduits 216. An outlet manifold 220 collects heated fluid received from outlet valves 210, through collection manifolds 222. The manually operated valves 200 and 210 are actuated manually to control the temperature of the collection electrodes 230, and individual discrete cooling chambers 252, isolated from one another in separate modules 240, supported on brackets 242, selectively are isolated from the cooling circuit by closing the appropriate valves 200 and 210.

Figure 6:
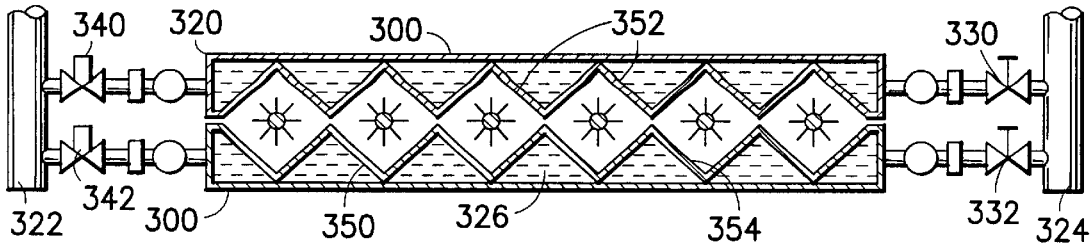
FIG. 6 is a transverse cross-sectional view illustrating another embodiment of improvements of the present invention.

Referring now to FIG. 6, modules 300 in an assembled condensing wet electrostatic precipitator 320 are located between a supply manifold 322 and an outlet manifold 324 of a cooling fluid circuit 326 which includes manual valves 330 and 332 and powered control valves 340 and 342, the powered control valves 340 and 342 being under the control of a controller (not shown) in an arrangement similar to that described above in connection with FIG. 2. Sections 350 of the modules 300 are semi-polygonal, with the assembled modules 300 establishing collection electrodes 352 having a polygonal cross-sectional configuration. In the embodiment of FIG. 6, the polygonal cross-sectional configuration is a rectangle, in the form of a generally square cross-sectional configuration 354.

Figure 7:
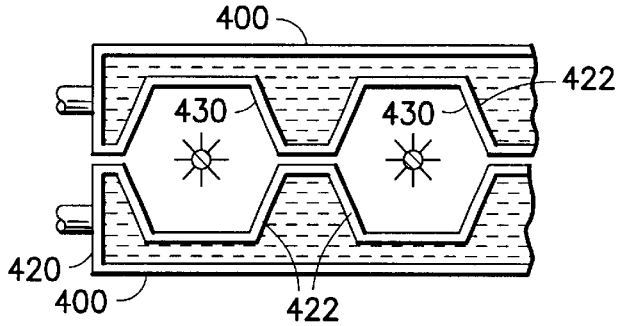
FIGS. 7 through 9 are fragmentary cross-sectional views somewhat similar to FIG. 6, and showing further embodiments of the improvement of the present invention.

In the embodiment of FIG. 7, modules 400 in an assembled condensing wet electrostatic precipitator 420 are semi-polygonal, with the sections 422 of the assembled modules 400 establishing collection electrodes 430 having a polygonal cross-sectional configuration, the polygonal cross-sectional configuration being generally hexagonal.

Figure 8:
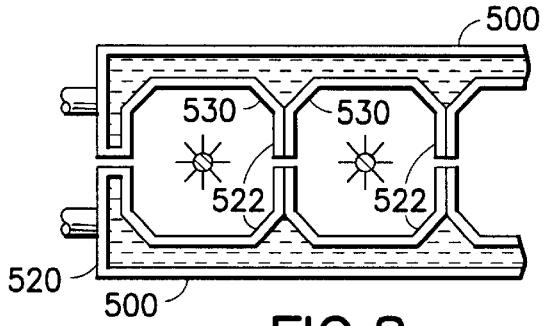

In the embodiment of FIG. 8, modules 500 in an assembled condensing wet electrostatic precipitator 520 are semi-polygonal, with the sections 522 of the assembled modules 500 establishing collection electrodes 530 having a polygonal cross-sectional configuration, the polygonal cross-sectional configuration being generally octagonal.

Figure 9:
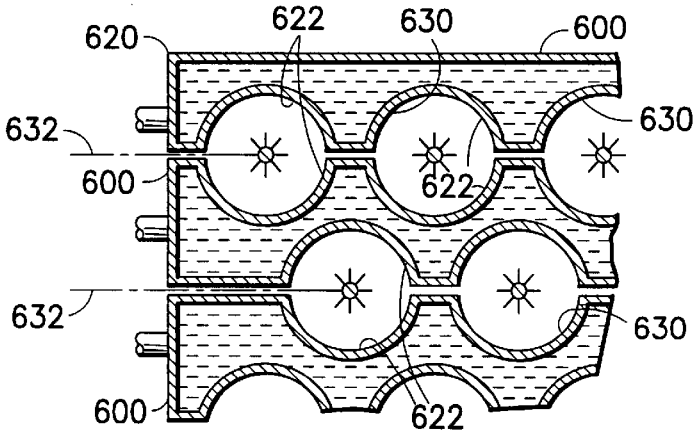

In the embodiment of FIG. 9, modules 600 in an assembled condensing wet electrostatic precipitator 620 are semi-circular, with the sections 622 of the assembled modules 600 establishing collection electrodes 630 having a generally circular cross-sectional configuration. The collection electrodes 630 are arranged in rows 632, with the collection electrodes 630 in adjacent rows 632 being staggered for a more compact assembly within which a greater number of collection electrodes 630 occupy a lesser overall cross-sectional area.

Figure 10:
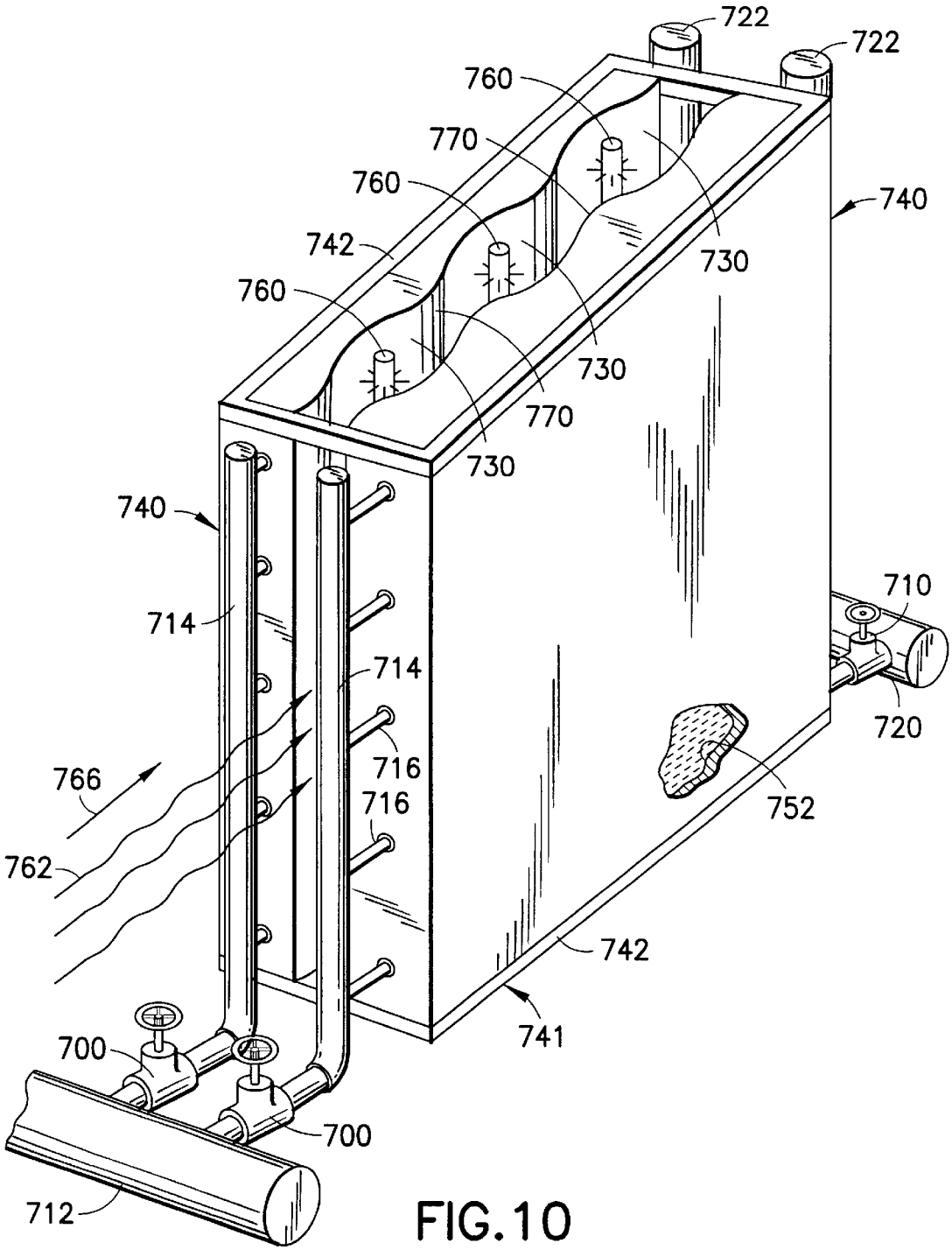
FIG. 10 is a pictorial perspective view of still another apparatus incorporating improvements of the present invention.

In the embodiment illustrated in FIG. 10, manually operated inlet valves 700 and outlet valves 710 are placed in a cooling circuit which includes a cooling fluid distributor arrangement having a supply manifold 712, distribution manifolds 714 and inlet conduits 716. An outlet manifold 720 collects heated fluid received from outlet valves 210, through collection manifolds 722. The manually operated valves 700 and 710 are actuated manually to control the temperature of collection electrodes 730, and individual discrete cooling chambers 752, isolated from one another in separate modules 740, supported on a frame 741 which includes brackets 742, selectively are isolated from the cooling circuit by closing the appropriate valves 700 and 710.

In the present embodiment of FIG. 10, discharge electrodes 760 extend in a longitudinal direction, within corresponding longitudinally extending collection electrodes 730, and the individual discrete cooling chambers 752 are spaced apart laterally from one another to enable the stream 762 of hot gases to pass through the collection electrodes 730 in a transverse direction 766, transverse to the longitudinal direction of the discharge electrodes 760 and the collection electrodes 730, and transverse to the lateral direction of the spacing between the cooling chambers 752. The undulate configuration of the walls 770 of the cooling chambers 752 provide part-tubular sections which, when juxtaposed as illustrated, establish the desired generally tubular configuration in the collection electrodes 730. In the illustrated embodiment, the tubular collection electrodes 730 have a somewhat partially circular cross-sectional configuration, with the part-tubular sections each including an arcuate cross-sectional configuration. The undulate configuration of the walls 770 of the cooling chambers 752 facilitate the flow of the stream 762 of hot gases in the transverse direction 766, while maintaining an effective cross-sectional configuration in the collection electrodes 730. Other configurations are available, as described in detail in connection with the earlier-illustrated embodiments.

Figure 11:
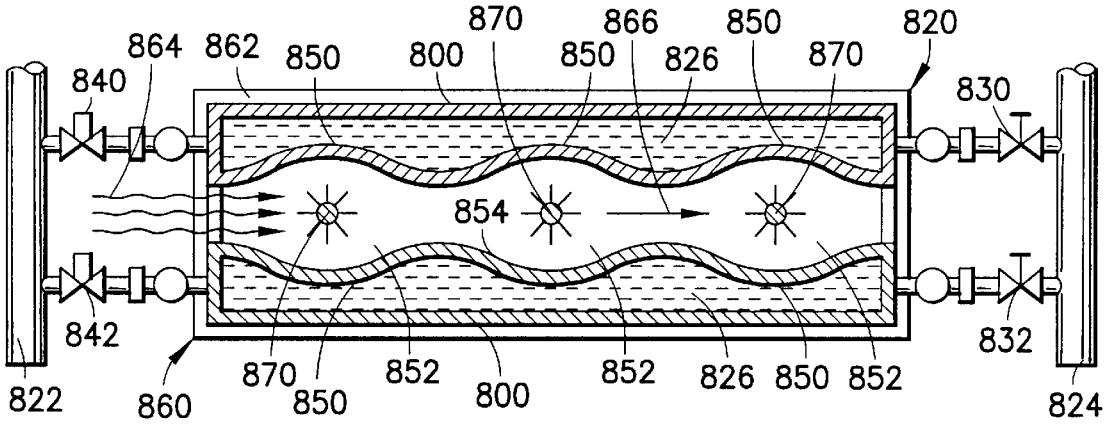
FIG. 11 is a transverse cross-sectional view illustrating another embodiment of improvements of the present invention.

Referring now to FIG. 11, modules 800 in an assembled condensing wet electrostatic precipitator 820 are located between a supply manifold 822 and an outlet manifold 824 of a cooling fluid circuit 826 which includes manual valves 830 and 832 and powered control valves 840 and 842, the powered control valves 840 and 842 being under the control of a controller (not shown) in an arrangement similar to that described above in connection with FIG. 2. Sections 850 of the modules 800 are arcuate in cross-sectional configuration, with the assembled modules 800 establishing collection electrodes 852 having a somewhat partial circular cross-sectional configuration, as a result of the undulate configuration of the walls 854 of the modules 800. Other configurations are available, as described in connection with the above illustrated embodiments.

Modules 800 are supported on a frame 860 which includes brackets 862 and are spaced apart laterally from one another to enable a stream 864 of hot gases to pass through the collection electrodes 852 in a transverse direction 866, transverse to the longitudinal direction of discharge electrodes 870 and the collection electrodes 852, and transverse to the lateral direction of the spacing between modules 800. The undulate configuration of the walls 854 facilitate the passage of the stream 864 of hot gases in the transverse direction 866 while maintaining an effective cross-sectional configuration in collection electrodes 852.

It will be seen that the improvement of the present invention attains the several objects and advantages summarized above, namely: Facilitates the fabrication and installation of a condensing wet electrostatic precipitator, enabling more economical construction and encouraging more widespread use of condensing wet electrostatic precipitators; enables ease of maintenance and repair of condensing wet electrostatic precipitators, with reduced shutdown requirements and extended continuous operation; allows the use of less expensive materials and construction techniques in the fabrication and installation of condensing wet electrostatic precipitators; utilizes a heat exchange arrangement which increases the effectiveness and efficiency of heat transfer in cooling the condensing walls of a condensing wet electrostatic precipitator; provides better control over the temperature of the walls of the condensing electrodes in a condensing wet electrostatic precipitator for providing better control over conditions desired for the formation of particle-capturing and flushing condensate, thereby increasing the efficiency and effectiveness of the condensing wet electrostatic precipitator in the removal of particulates; allows the construction and installation of larger condensing wet electrostatic precipitators with increased ease and economy; facilitates the fabrication of components of a condensing wet electrostatic precipitator in the factory and assembly in the field to enable greater ease and economy; provides apparatus and process for effective and reliable operation over an extended service life.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. An improvement in a wet electrostatic precipitator having discharge electrodes extending in a longitudinal direction within generally tubular collection electrodes placed within a cooling jacket containing a cooling medium for cooling the collection electrodes as hot gases are passed through the collection electrodes in a transverse direction transverse to the longitudinal direction, the improvement comprising:

collection electrode modules for establishing the collection electrodes and the cooling jacket, each collection electrode module having a configuration including at least one part-tubular section and a cooling fluid chamber integral with the part-tubular section for containing cooling medium for cooling the part-tubular section;

the configuration of each collection electrode module being such that upon assembly of the collection electrode modules into an assembly of juxtaposed collection electrode modules the part-tubular sections are juxtaposed to establish at least one corresponding generally tubular collection electrode comprised of the juxtaposed part-tubular sections, and are spaced apart laterally to enable the hot gases to pass through the collection electrodes in the transverse direction, and the cooling fluid chambers are juxtaposed to establish a corresponding cooling jacket comprised of the juxtaposed cooling fluid chambers.

2. The improvement of claim 1 wherein each part-tubular section comprises a semi-tubular section, and each collection electrode module includes a plurality of the semi-tubular sections.

3. The improvement of claim 2 including a frame for supporting the assembly of juxtaposed collection electrode modules.

4. The improvement of claim 1 wherein the cooling chambers comprise individual, discrete cooling fluid chambers isolated from one another in the assembly, and the improvement includes a cooling fluid distributor arrangement for distributing cooling fluid among the juxtaposed discrete cooling fluid chambers.

5. The improvement of claim 4 including regulators for regulating the distribution of cooling fluid in accordance with temperature demands along the generally tubular collection electrodes.

6. The improvement of claim 5 wherein the regulators include a plurality of fluid inlets distributed throughout the cooling jacket, counterpart valves for controlling the flow of fluid through the inlets to the cooling jacket, and a controller for controlling the valves in accordance with the temperature demands.

7. The improvement of claim 1 wherein the part-tubular sections each include an arcuate cross-sectional configuration.

8. The improvement of claim 1 wherein each generally tubular collection electrode is established by two collection electrode modules and each part-tubular section has an undulate cross-sectional configuration.

* * * * *